US007712799B2

(12) United States Patent
Peng

(10) Patent No.: US 7,712,799 B2
(45) Date of Patent: May 11, 2010

(54) HIDDEN LOCK LOCKED TO AN INNER SIDE OF A DOORPLATE

(75) Inventor: Fu-Chang Peng, Shulin (TW)

(73) Assignee: Fu Chang Locks Mfg Corp., Shulin, Taipei County (TW)

( * ) Notice: Subject to any disclaimer, the term of this patent is extended or adjusted under 35 U.S.C. 154(b) by 72 days.

(21) Appl. No.: 11/949,756

(22) Filed: Dec. 3, 2007

(65) Prior Publication Data

US 2009/0139283 A1 Jun. 4, 2009

(51) Int. Cl.
*E05B 65/10* (2006.01)

(52) U.S. Cl. ..... 292/92; 292/156; 292/137; 292/DIG. 66

(58) Field of Classification Search ..... 292/92, 292/137, 163, 164, 166–168, 177, 179, 138, 292/139, DIG. 46, DIG. 65, DIG. 66 X; 70/92
See application file for complete search history.

(56) References Cited

U.S. PATENT DOCUMENTS 4,005,886 A * 2/1977 Lirette ..... 292/177
4,099,753 A * 7/1978 Gwozdz et al. ..... 292/177
4,445,717 A * 5/1984 Imhoff ..... 292/177
5,076,620 A * 12/1991 Campbell et al. ..... 292/138
5,464,259 A * 11/1995 Cohrs et al. ..... 292/92
5,527,074 A * 6/1996 Yeh ..... 292/177
6,283,513 B1 * 9/2001 Yeh ..... 292/92
6,820,905 B1 * 11/2004 Haeck et al. ..... 292/93
6,883,837 B1 * 4/2005 Lin ..... 292/33
6,945,571 B2 * 9/2005 Lin ..... 292/92
7,118,141 B2 * 10/2006 Cohrs et al. ..... 292/92

* cited by examiner

*Primary Examiner*—Peter M. Cuomo
*Assistant Examiner*—Mark Williams

(57) ABSTRACT

A hidden lock locked to an inner side of a doorplate comprises a top seat assembly; a top rod; the top seat assembly being assembled to the top rod; a linking rod installed to a lower side of the top rod; a lower rod; a lower head; a top seat assembly; a resisting unit. The connecting shaft having a groove, plurality of slots, a plurality of holes, an upper engaging tube and a lower engaging tube. A bent stop is extended from the resisting unit. When a top rod reduces inwards, the stop will resist against a neck of the top rod to prevent a lower head to contact the ground. A pin device is installed for retaining the lock in high temperature.

4 Claims, 10 Drawing Sheets

HIDDEN LOCK LOCKED TO AN INNER SIDE OF A DOORPLATE

FIELD OF THE INVENTION

The present invention relates to door locks, and particular to a hidden door lock locked to an inner side of a doorplate having a top seat assembly with a resisting unit. A bent stop is extended from the resisting unit. When a top rod reduces inwards, the stop will resist against a neck of the top rod to prevent a lower head to contact the ground. A pin device is installed for retaining the lock in high temperature.

BACKGROUND OF THE INVENTION

For preventing fire accident in high building, fireproof doors are widely installed between different floors. Generally, the locks of the fireproof doors are installed in the doorframes and have very complicated structures so that the manufacturing processes are tedious. Furthermore, the lock is difficult in operation and is easy to have faults. Especially, when the fireproof door is opened, a lower protruded head will protrude upwards due to a compression of a spring so that it will contact the groove with the movement of the door. Not only the ground is worn and the door will be destroyed. Furthermore, generally, the fireproof door is closed, when fire accident occurs.

In general design, in high temperature, the buckling studs will not reduce inwards and then the fireproof doors will not open automatically so as to prevent the expansion of fire. This is the main function of the fireproof door.

SUMMARY OF THE INVENTION

Accordingly, the primary object of the present invention is to provide a hidden door lock locked to an inner side of a doorplate having a top seat assembly with a resisting unit. A bent stop is extended from the resisting unit. When a top rod reduces inwards, the stop will resist against a neck of the top rod to prevent a lower head to contact the ground. A pin device is installed for retaining the lock in high temperature.

To achieve above objects, the present invention provides a hidden lock locked to an inner side of a doorplate; the lock having a lock body which has a swingable crank; a cover covering upon the lock body; a horizontal pressable handle having one end extending to the lock body so as to contact one end of the crank; a retainer and an assembly cover covering upon the end of the handle; the lock comprising: a top seat assembly; a top rod; the top seat assembly being assembled to the top rod; a linking rod installed to a lower side of the top rod by using a pin to pass the top rod and the linking rod; a lower end of the linking rod having thread; a lower rod having a thread at an upper side thereof and a lower end of the lower rod having a hole; the thread of the lower rod being engaged into the lower engaging tube; a lower head having a receiving space for receiving a lower end of the lower rod; a spring being placed in the receiving space of the lower head and below a lower bottom of the lower rod; two opposite lateral sides of the lower head having a respective slot; a pin passing through the slot to be inserted into the hole; the pin of the lower head being slideable along the slots of the lower head; a top seat assembly including an upper supporting sheet and a lower supporting sheet; each of the upper supporting sheet and the lower supporting sheet having an opening; the top rod passing through the openings of the upper supporting sheet and lower supporting sheet; the opening of the upper supporting sheet having a protrusion at an upper side thereof; a resisting unit installed in the receiving groove; an upper end of the resisting unit being retained to the upper supporting sheet by using a retaining bar to pass through the upper end of the resisting unit to an upper side of the upper supporting sheet; one lower end of the resisting unit being combined to upper supporting sheet by using a post to pass through holes of the upper supporting sheet and resisting unit; a front side of the resisting unit being extended with a bent stop; an elastic unit being installed at two lower legs of the resisting unit; the post passing through the elastic unit to fix the elastic unit to the lower supporting sheet; the lower supporting sheet being formed with a recess; two opposite sides of walls of the recess having holes; an inner side of each hole of the recess having a retaining stud; a small part of the stud being installed in the hole of the recess; and a large part of the stud resisting against an inner side of the hole of the recess; a protrusion of the pin being inserted into a hole in the stud; a press unit having a U shape end; the pin passing through the U shape end to be retained therein; an O ring enclosing the pin and is at an inner side of the press unit; one end of the press unit having a round hole; a screw serving to fix the press unit to the lower supporting sheet; wherein when the press unit is pressed downwards in fire accident and in high temperature, the O ring will melt and the pin will pass through the retaining stud to insert into the through hole of the top rod to fix the lock so as to prevent the fire from expansion; and the connecting shaft having a groove, plurality of slots, a plurality of holes, an upper engaging tube and a lower engaging tube.

The various objects and advantages of the present invention will be more readily understood from the following detailed description when read in conjunction with the appended drawing.

DETAILED DESCRIPTION OF THE INVENTION

Figure 1:
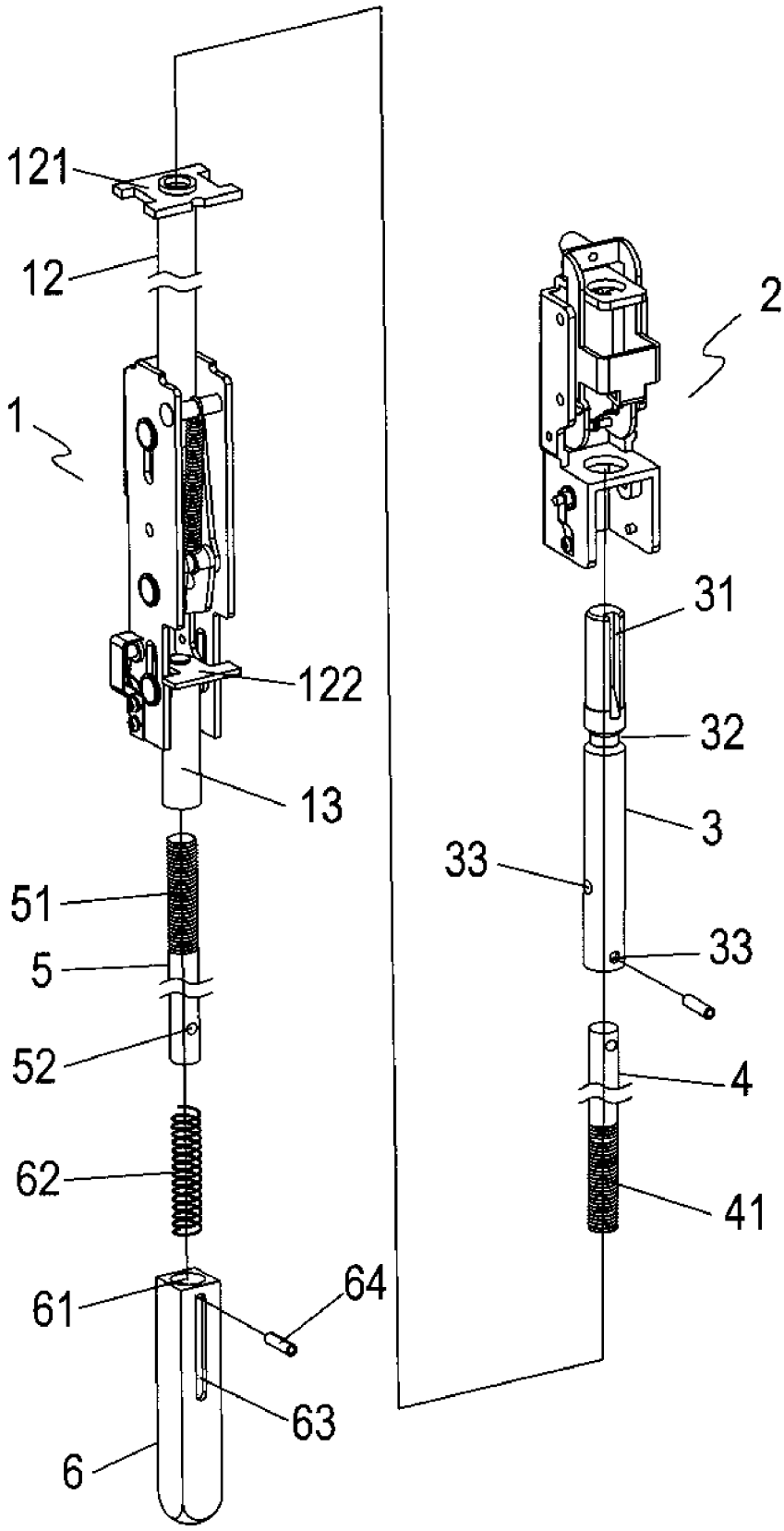
FIG. 1 is an explosive schematic view of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1, 2, 9 and 10, the structure of the present invention is illustrated.

The lock 10 of the present invention is locked to an inner side of a doorplate. The lock has the following elements.

A lock body 8 has a swingable crank 81. A cover 82 covers upon the lock body 8.

A horizontal pressable handle 9 has one end extending to the lock body 8 so as to contact one end of the crank 81. A retainer 91 and an assembly cover 92 covers upon the end of the handle 9.

The structure of the lock body 8 and handle 9 are known in the prior art.

The lock 10 has a top seat assembly 2 which is assembled with a top rod 3.

A linking rod 4 is installed to a lower side of the top rod 3 by using a pin to pass the top rod 3 and the linking rod 4. A lower end of the linking rod 4 has thread 41.

A lower rod 5 has a thread 51 at an upper side thereof and a lower end of the lower rod 5 has a hole 52. The thread 51 of the lower rod 5 is engaged into the lower engaging tube 13.

A lower head 6 has a receiving space 62 receiving a lower end of the lower rod 5. A spring 62 is placed in the receiving space 62 of the lower head 6 and below a lower bottom of the lower rod 5. Two opposite lateral sides of the lower head 6 have respective slots 63. A pin 64 passes through the slot 63 to be inserted into the hole 52. The pin 64 of the lower head 6 is slideable along the slots 63 of the lower head 6.

Figure 3:
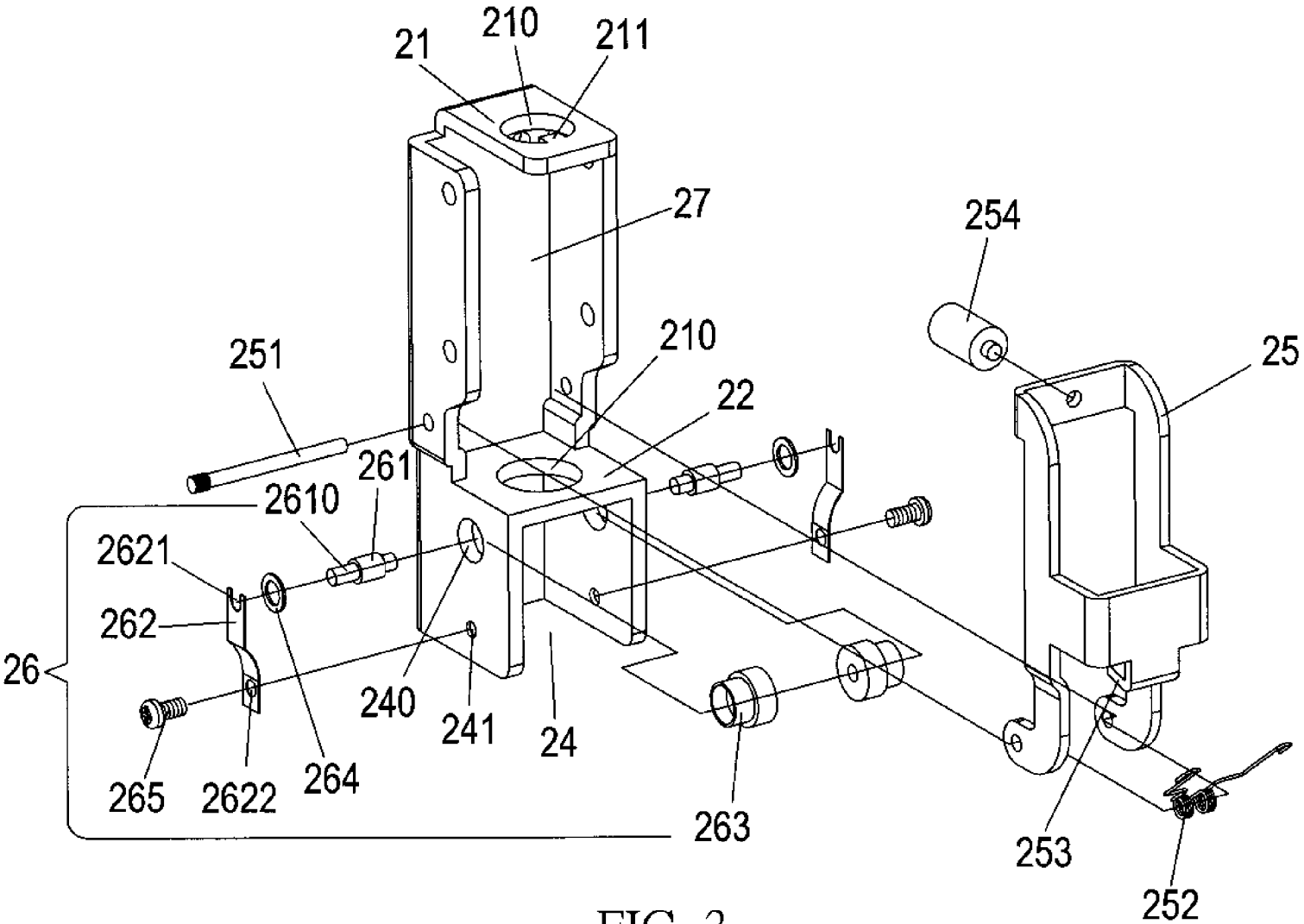
FIG. 3 is an explosive schematic view of the present invention.
Figure 4:
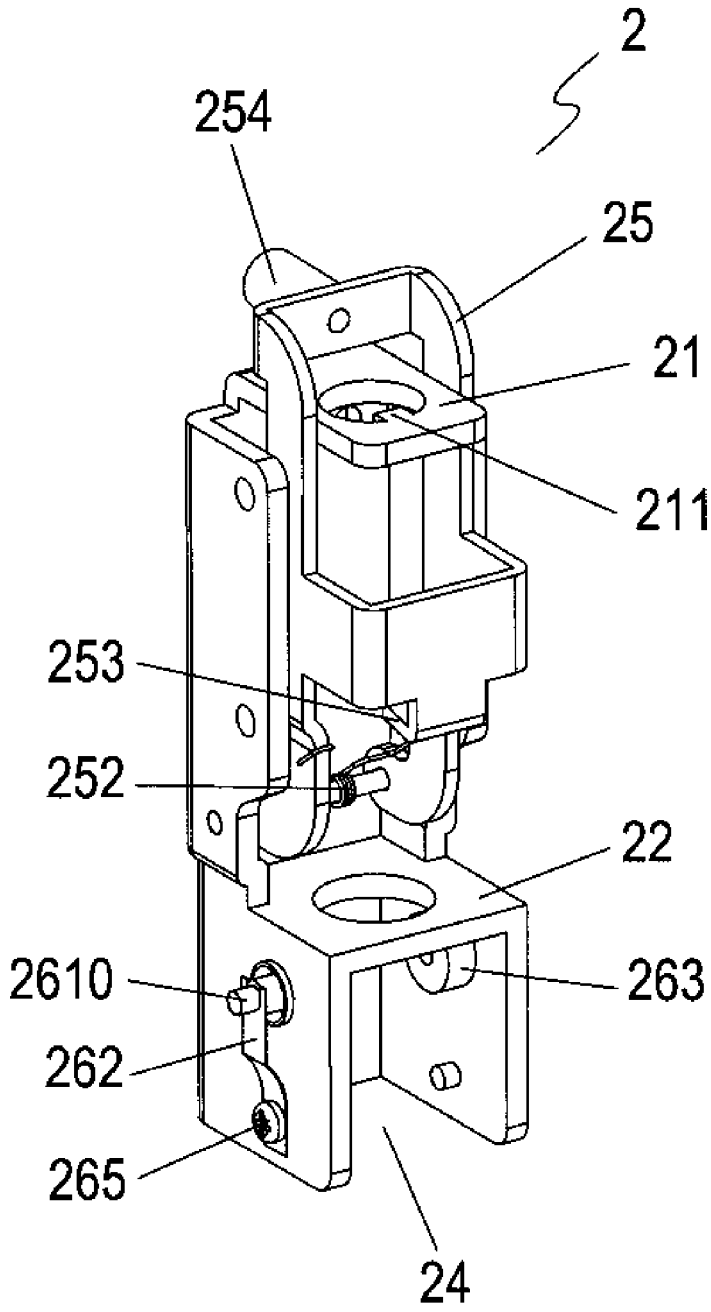
FIG. 4 is an assembled schematic view of the present invention.
Figure 5:
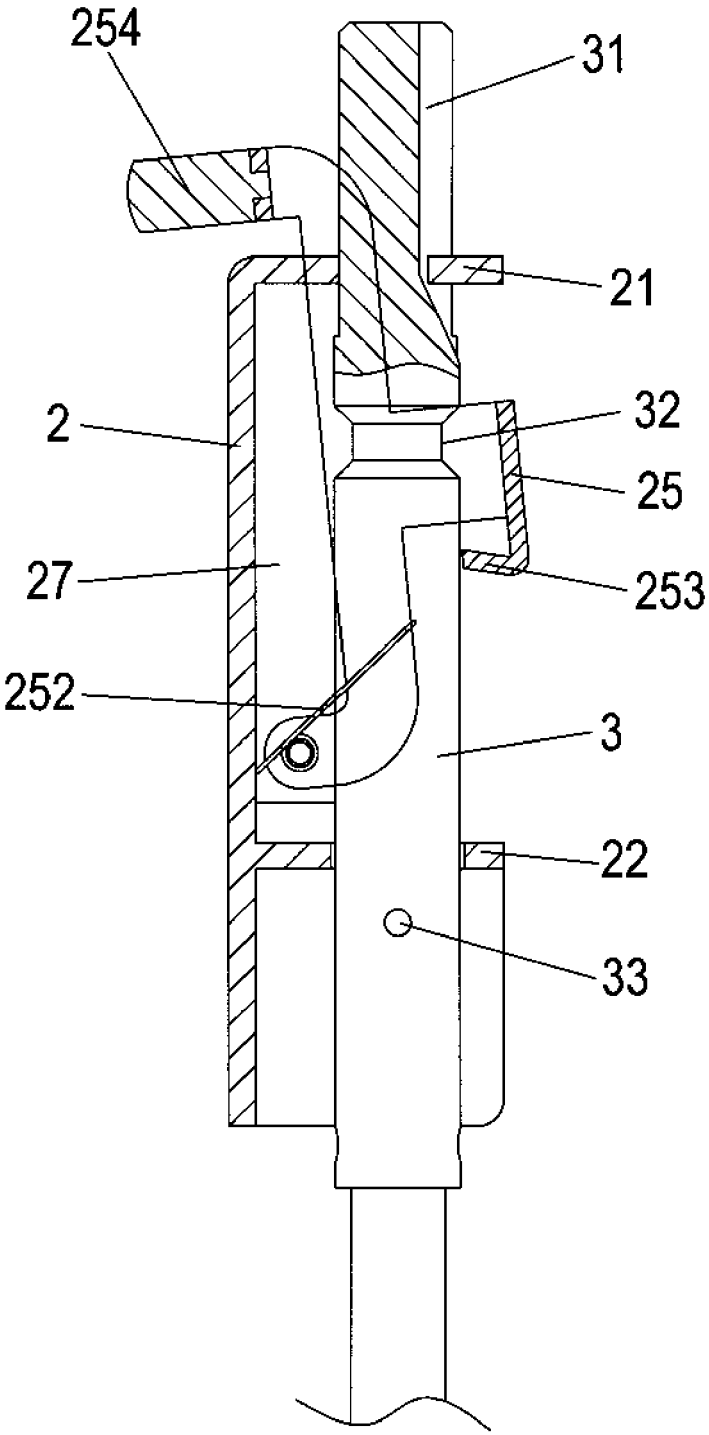
FIG. 5 shows the operation of the door lock of the present invention.

Referring to FIGS. 1, 3 and 5, the elements related to the present invention will be further described herein.

A top seat assembly 2 includes an upper supporting sheet 21 and a lower supporting sheet 22. Each of the upper supporting sheet 21 and the lower supporting sheet 22 has an opening 210. The top rod 3 passes through the openings 210 of the upper supporting sheet 21 and lower supporting sheet 22.

The opening 210 of the upper supporting sheet 21 has a protrusion 211 at an upper side thereof.

A resisting unit 25 is installed in the receiving groove 27. An upper end of the resisting unit 25 is retained to the upper supporting sheet 21 by using a retaining bar 254 to pass through the upper end of the resisting unit 25 to an upper side of the upper supporting sheet 21.

One lower end of the resisting unit 25 is combined to upper supporting sheet 21 by using a post 251 to pass through holes of the upper supporting sheet 21 and the resisting unit 25. A front side of the resisting unit 25 is extended with a bent stop 253. An elastic unit 252 is installed at two lower legs of the resisting unit 25. The post 251 passes through the elastic unit 252 so fix the elastic unit 252 to the lower supporting sheet 22.

The lower supporting sheet 22 is formed with a recess 24. Two opposite sides of walls of the recess 24 have holes 240. An inner side of each hole 240 of the recess 24 has a retaining stud 263. A small part of the stud 263 is installed in the hole 240 of the recess 24 and a large part of the stud 263 resists against an inner side of the hole 240 of the recess 24. A protrusion 2610 of the pin 261 is inserted into a hole in the stud 263. A press unit 262 has a U shape end 2621. The pin 261 passes through the U shape end 2621 to be retained therein. An O ring 264 encloses the pin 261 and is at an inner side of the press unit 262. One end of the press unit 262 has a round hole 2622. A screw 265 serves to fix the press unit 262 to the lower supporting sheet 22.

Figure 2:
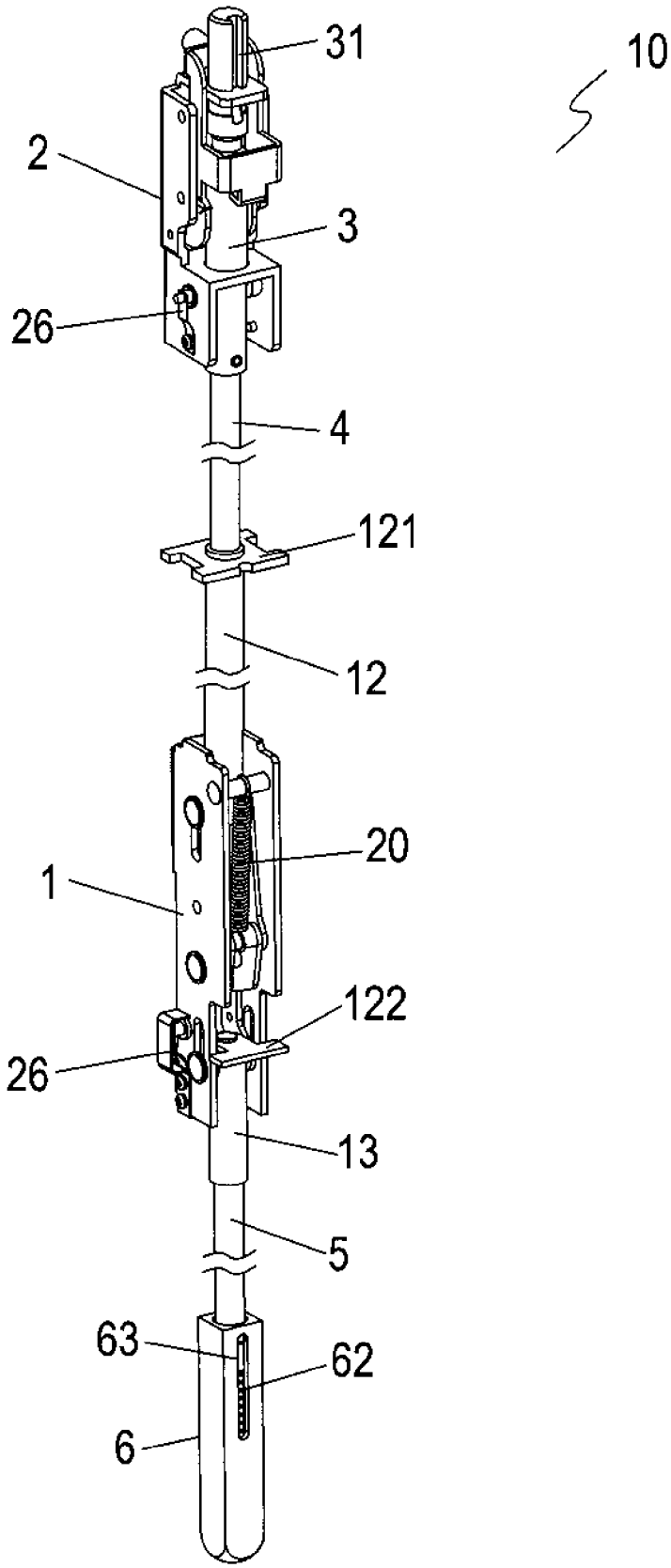
FIG. 2 is an assembled schematic view of the present invention.
Figure 6:
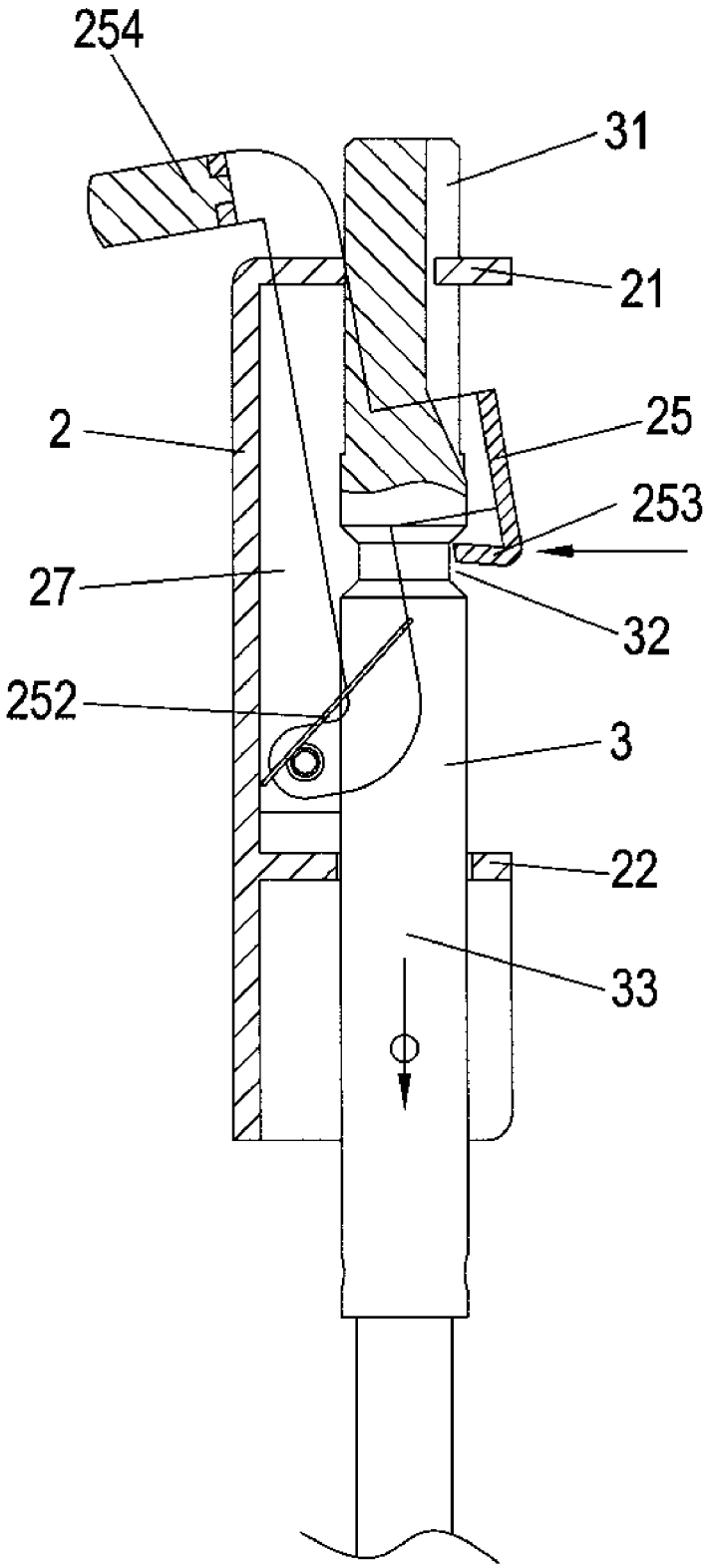
FIG. 6 shows the opening of the door through the top seat structure of the present invention.

Referring to FIGS. 2, 5 and 6, the structure of the top rod 3 of the present invention is illustrated. The top rod 3 has a slot 31, a neck 32 below the slot 31 and a plurality of through holes 33. The slot 31 is corresponding to the protrusion 211 of the upper supporting sheet 21. In assembly (see FIG. 2), the top rod 3 passes through the opening 210 of the upper supporting sheet 21. The protrusion 211 resists against the top rod 3 to prevent the top rod 3 from loosing so that the top rod 3 is adjustable to make the neck 32 of the top rod 3 being at a predetermined position with respect to the bent stop 253 of the resisting unit 25 so that the assembly work can be positioned easily.

When the press unit 262 is pressed downwards in fire accident and thus in high temperature, the O ring 264 will melt and the pin 261 will pass through the retaining stud 253 to insert into the through hole 33 of the top rod 3 to fix the lock so as to prevent the fire from expansion.

Figure 7:
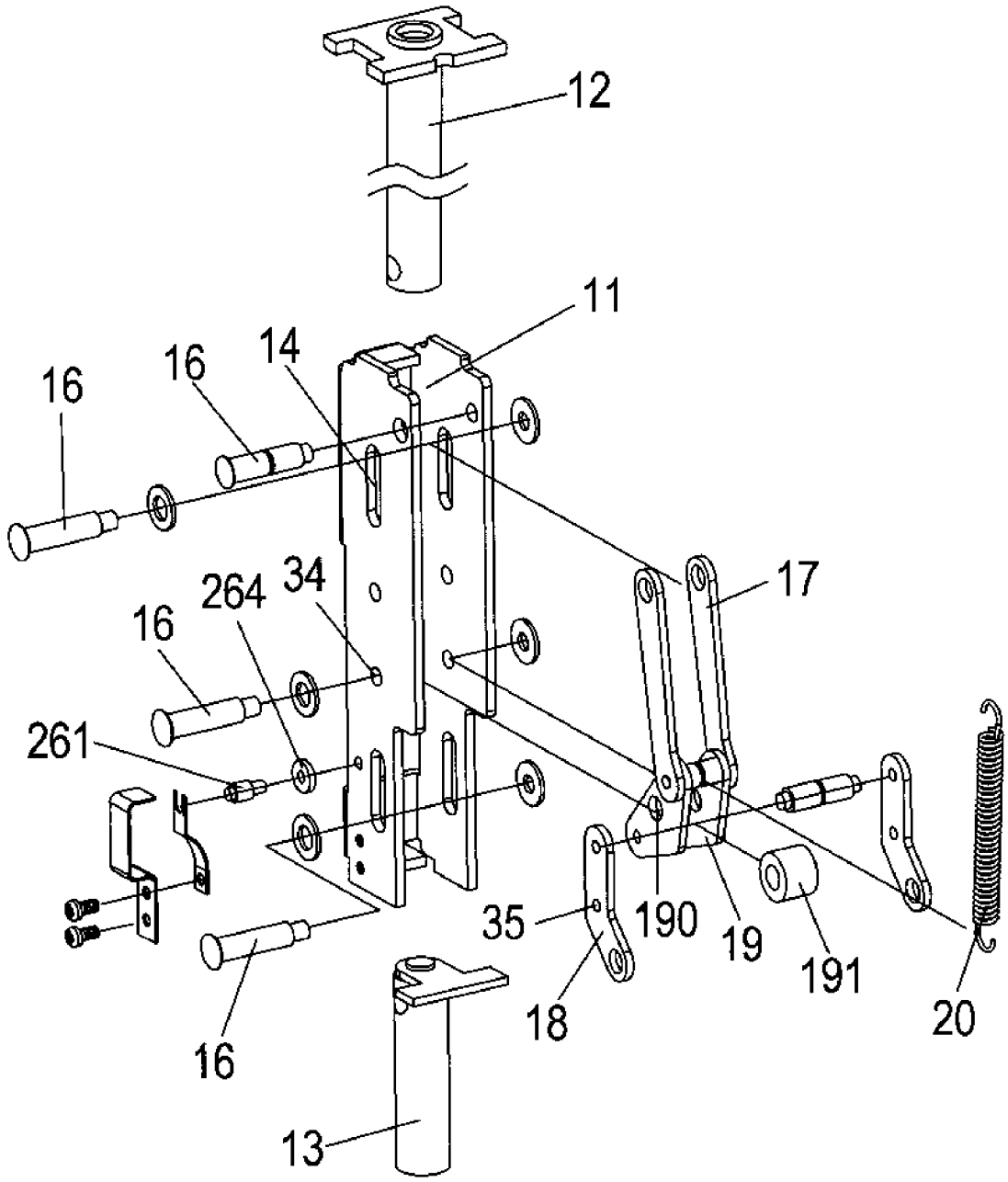
FIG. 7 is an explosive schematic view of the connecting shaft according to the present invention.
Figure 8:
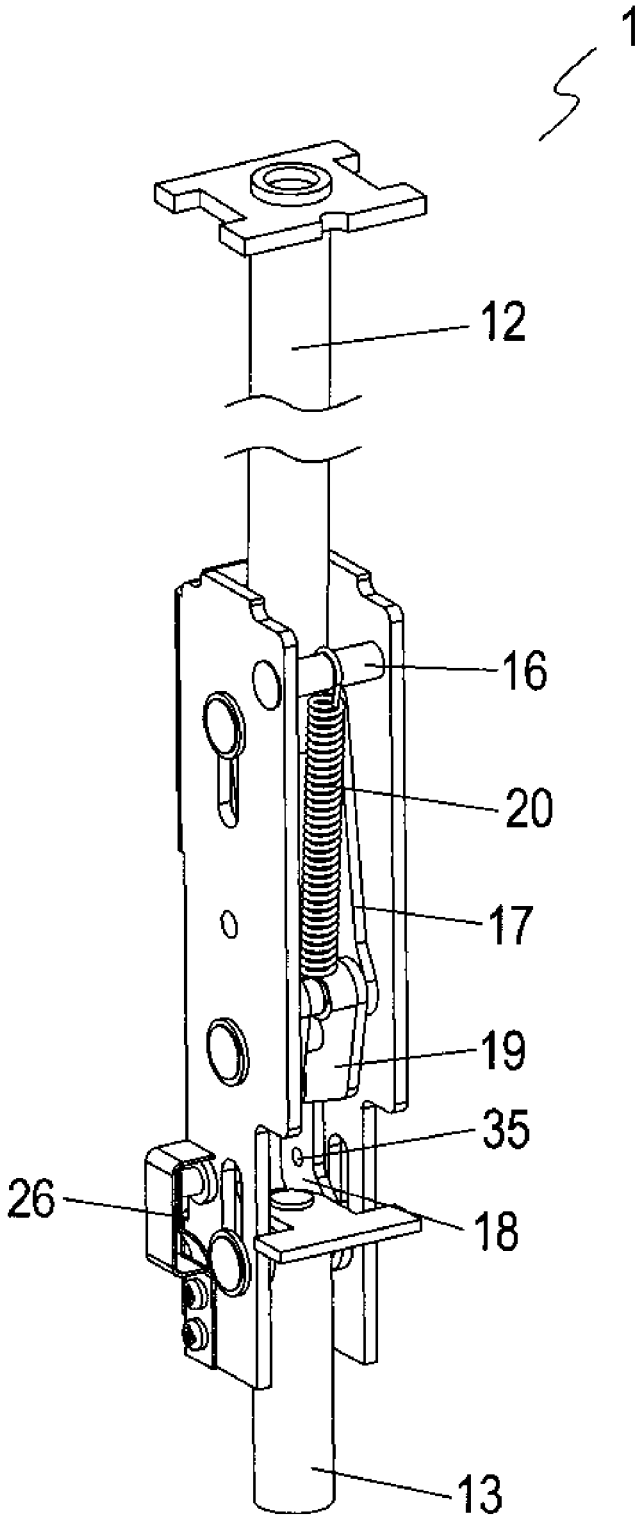
FIG. 8 shows an assembled schematic view of the connecting shaft according to the present invention.
Figure 9:
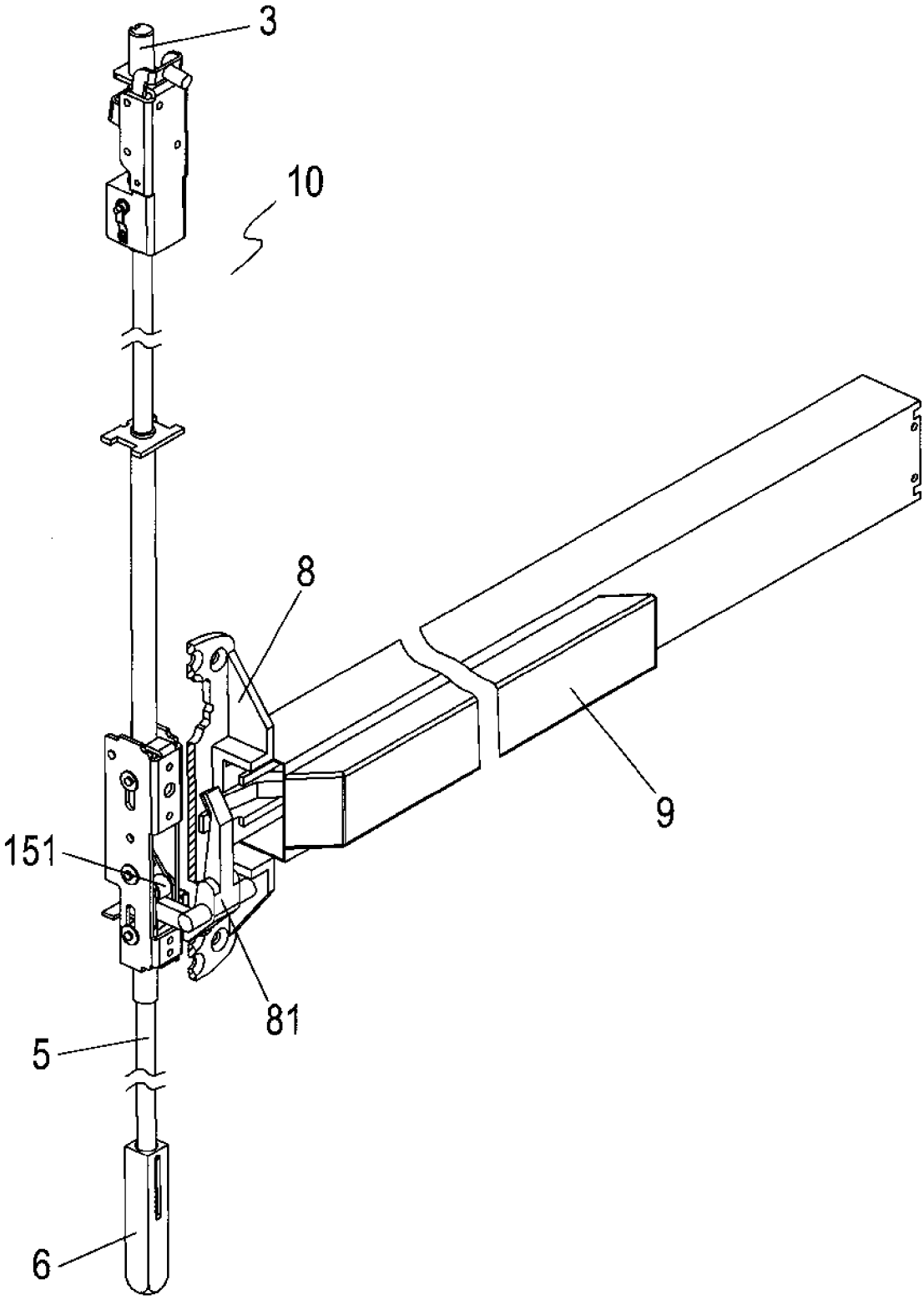
FIG. 9 is a schematic view about a preferred embodiment of the present invention.
Figure 10:
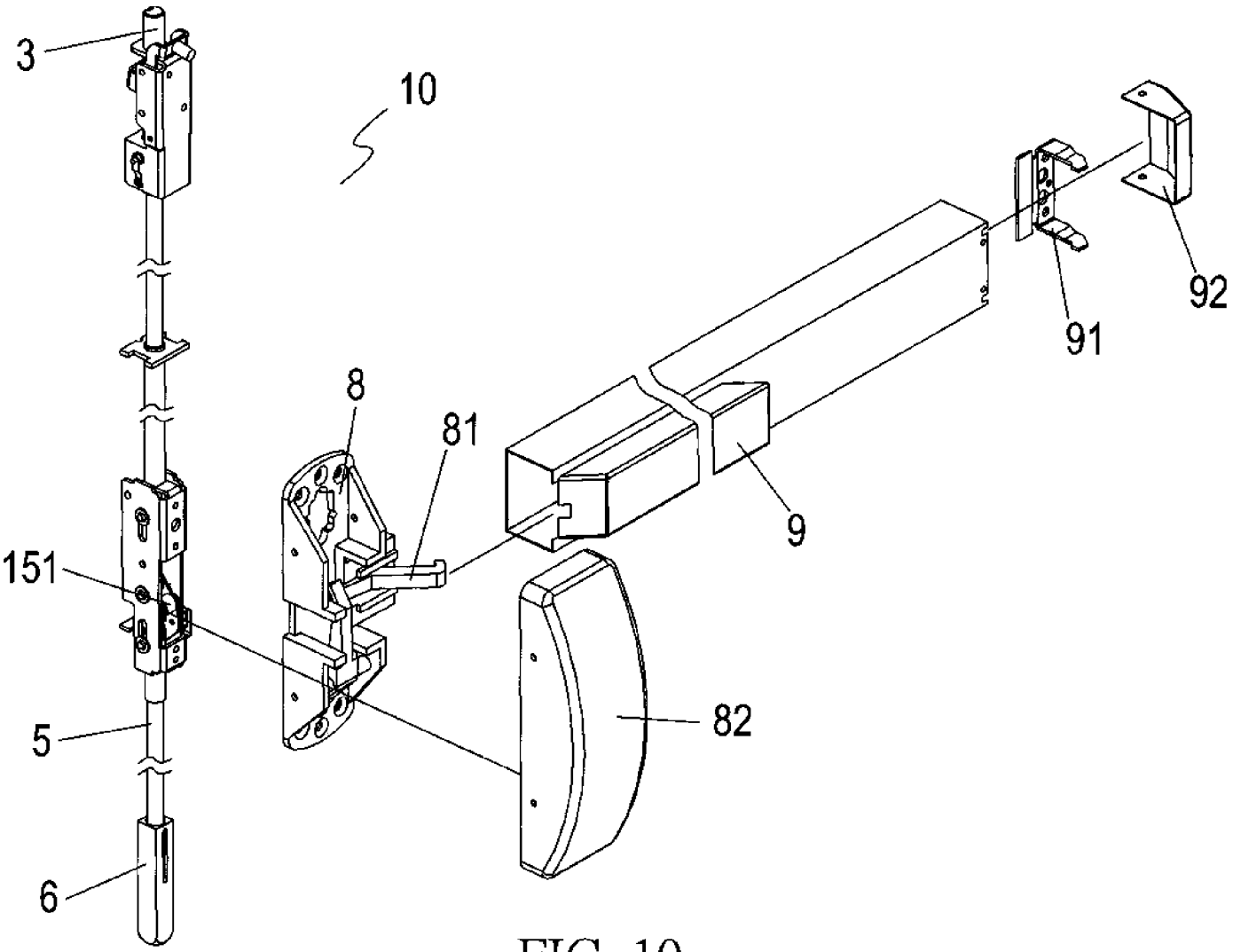
FIG. 10 is an explosive schematic view about the preferred embodiment of the present invention.

Referring to FIGS. 7 and 8, the exploded view of the connecting shaft 1 of the present invention is illustrated. The connecting shaft 1 has a groove 11, a plurality of slots 14, a plurality of holes 34, an upper engaging tube 12 and a lower engaging tube 13. A plurality of rivets 16 passes through the slots 14 and the holes 34 to retain the upper engaging tube 12 and lower engaging tube 13 in the groove 11. Each rivet 16 passes through two opposite sides of the groove 11 so that the upper engaging tube 12 and lower engaging tube 13 are rotatable in the groove 11. Two interconnect units 17 are installed to a rivet 16 which retain the upper engaging tube 12. Two linking units 18 are connected to the rivet 16 retaining the lower engaging tube 13. Each pair of the interconnect unit 17 and the linking unit 18 are pivoted to two ends of a transfer sheet 19. A central area of the transfer sheet 19 has a hole 190 for receiving a rivet 16. A buckle 191 is retained between the two transfer sheets 19. The swingable crank 81 is in contact with the hook 191 of the interconnect shaft 19. The crank 81 will drive the hook 191 to move. A pin passes through the two interconnect unit 17 and two transfer sheets 19 so as to retain the two pairs of the interconnect units 17 and the two transfer sheets 19. An elastic element 20 is connected between two rivets 16.

A top side of the lower engaging tube 13 has an expanding sheet 122 for retaining the lower engaging tube 13 in the groove 11. An upper side of the upper engaging tube 12 has an expanding sheet 121.

In assembly the upper engaging tube 12 is engaged to the thread 41 at a lower end of the linking rod 4. The upper engaging tube 12 and lower engaging tube 13 are slidable along the slots 14. The crank 81 is buckled to the hook 191 so that the crank 81 can drive the buckle 191 to move to separate an end of the top rod 3. The end portion of the top rod 3 is pulled away and the lower head 6 is reduced back to separate from a latch. A lateral side of the connecting shaft 1 is installed with at least one insertion device 26. In fire accident, in high temperature, the O ring 264 will melt. The pin 261 will pass through the connecting shaft 1 to insert into the hole 35 of the transfer unit 18 to fix the lock and prevent air from expansion.

When the top rod 3 reduces inwards, the elastic element 20 will be compressed. The resisting unit 25 will move toward an inner side of the groove 23 due to the elastic force of the elastic unit 252 so that the stop 253 resists against the neck 32 of the top rod 3 to fix the top rod 3 and the lower rod 5 so as to prevent the head 6 from contacting the ground. When the door is closed, the retaining bar 254 resists against a doorframe so that the stop 253 separates from the neck 32 of the top rod 3. The elastic element 20 of the connecting shaft 1 will release the elastic force to make the end portion of the top rod 3 to insert into the head 6 so as to be inserted into the latch to be fixed therein.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hidden lock capable being locked to an inner side of a doorplate; the lock (10) having a lock body (8) which has a swingable crank (81); a cover (82) covering the lock body (8); a horizontal pressable handle (9) having one end extending to the lock body (8) so as to contact one end of the crank (81); a retainer (91) and an assembly cover (92) covering the end of the handle (9); the lock (10) comprising:

a top seat assembly (2);

a top rod (3); the top seat assembly (2) being assembled to the top rod (3);

a linking rod (4) installed to a lower side of the top rod (3) by using a pin (64) to pass a through hole of the top rod (3) and a through hole of the linking rod (4); a lower end of the linking rod (4) having outer threads;

a lower rod (5) having outer threads at an upper side thereof and a lower end of the lower rod having a hole (52); the outer thread of the lower rod (5) being engaged into interior of a lower engaging tube (13);

a lower head (6) having a receiving space (62) for receiving a lower end of the lower rod (5); a spring (62) being placed in the receiving space (62) of the lower head (6) and below a lower bottom of the lower rod (5); two opposite lateral sides of the lower head (6) having a respective slot (63); a pin (64) passing through the slot (63) to be inserted into the hole (52); the pin (64) of the lower head (6) being slideable along the slots (63) of the lower head (6);

the top seat assembly (2) including an upper supporting sheet (21) and a lower supporting sheet (22); each of the upper supporting sheet (21) and the lower supporting sheet (22) having an opening (210); the top rod (3) passing through the openings (210) of the upper supporting sheet (21) and the lower supporting sheet (22);

the opening (210) of the upper supporting sheet (21) having a protrusion (211) at an upper side thereof;

a resisting unit (25) installed in the receiving groove (27); an upper end of the resisting unit (25) being retained to the upper supporting sheet (21) by using a retaining bar (254) to pass through the upper end of the resisting unit (25) to an upper side of the upper supporting sheet (21); one lower end of the resisting unit (25) being combined to the upper supporting sheet (21) by using a post (251) to pass through holes of the upper supporting sheet (21) and the resisting unit (25); a front side of the resisting unit (25) being extended with a bent stop (253); an elastic unit (252) being installed at two lower legs of the resisting unit (25); the post (251) passing through the elastic unit (252) to fix the elastic unit (252) to the lower supporting sheet (22);

the lower supporting sheet (22) being formed with a recess (24); two opposite sides of walls of the recess (24) having holes (240); an inner side of each hole (240) of the recess (24) having a retaining stud (263); a small part of the stud (263) being installed in the hole of the recess (24); and a large part of the stud (263) resisting against an inner side of the hole (240) of the recess (24); a protrusion (2610) of the pin (261) being inserted into a hole in the stud (263); a press unit (262) having a U shape end (2621); the pin (261) passing through the U shape end (2621) to be retained therein; an O ring (264) enclosing the pin (261) and being at an inner side of the press unit (262); one end of the press unit (262) having a round hole (2622); a screw (265) serving to fix the press unit (262) to the lower supporting sheet (22); and the connecting shaft (1) having a groove (11), a plurality of slots (14), a plurality of holes (34), an upper engaging tube (12) and a lower engaging tube (13).

2. The hidden lock as claimed in claim 1, wherein the top rod has a slot, a neck below the slot and a plurality of through holes; a top seat assembly is assembled to the top rod; the slot is corresponding to the protrusion of the upper supporting sheet; in assembly, the top rod passes through the opening of the upper supporting sheet; the protrusion resists against the top rod to prevent the top rod from loosing so that the top rod is adjustable to make the neck of the top rod being at a predetermined position with respect to the bent stop of the resisting unit so that the assembly work can be positioned easily.

3. The hidden lock as claimed in claim 2, wherein a plurality of rivets passes through the slots and the holes to retain the upper engaging tube and the lower engaging tube in the groove; each rivet passes through two opposite sides of the groove so that the upper engaging tube and lower engaging tube are rotatable in the groove; two interconnect units are installed to a rivet which retain the upper engaging tube; two linking units are connected to the rivet for retaining the lower engaging tube; each pair of the interconnect unit and the linking unit are pivoted to two ends of a transfer sheet; a central area of the transfer sheet has a hole for receiving a rivet; a buckle is retained between the two transfer sheets; the swingable crank is in contact with the hook of the interconnect shaft; the crank will drive the hook to move; a pin passes through the two interconnect unit and two transfer sheets so as to retain the two pairs of the interconnect units and the two transfer sheets; and an elastic element is connected between two rivets.

4. The hidden lock as claimed in claim 1, wherein a top side of the lower engaging tube having an expanding sheet for retaining the lower engaging tube in the groove; and an upper side of the upper engaging tube having an expanding sheet.

* * * * *